US011414896B2

(12) United States Patent
Brickner

(10) Patent No.: US 11,414,896 B2
(45) Date of Patent: Aug. 16, 2022

(54) MOTOR VEHICLE LOCK

(71) Applicant: Kiekert AG, Heiligenhaus (DE)

(72) Inventor: Robert L. Brickner, Berkley, MI (US)

(73) Assignee: Kiekert AG, Heiligenhaus (DE)

( * ) Notice: Subject to any disclaimer, the term of this patent is extended or adjusted under 35 U.S.C. 154(b) by 594 days.

(21) Appl. No.: 16/297,876

(22) Filed: Mar. 11, 2019

(65) Prior Publication Data

US 2020/0291691 A1 Sep. 17, 2020

(51) Int. Cl.
*E05B 77/06* (2014.01)
*E05B 79/08* (2014.01)

(52) U.S. Cl.
CPC ..... *E05B 77/06* (2013.01); *E05B 79/08* (2013.01)

(58) Field of Classification Search
CPC ..... E05B 77/06; E05B 79/08; E05B 77/04; E05B 77/02; Y10T 292/03; Y10S 292/22
See application file for complete search history.

(56) References Cited

U.S. PATENT DOCUMENTS

| | | | | |
|---|---|---|---|---|
| 8,764,077 | B2 * | 7/2014 | Takagi | E05B 77/06 292/336.3 |
| 9,376,842 | B2 * | 6/2016 | Wittelsbuerger | E05B 77/12 |
| 2003/0234544 | A1 * | 12/2003 | Jankowski | E05B 77/06 292/220 |
| 2014/0284944 | A1 * | 9/2014 | Rosales | E05B 85/26 292/113 |
| 2014/0312630 | A1 * | 10/2014 | Bendel | E05B 85/10 292/195 |
| 2016/0010363 | A1 * | 1/2016 | Wahmann | E05B 77/04 292/92 |
| 2017/0114574 | A1 * | 4/2017 | Topfer | E05B 77/38 |
| 2020/0190863 | A1 * | 6/2020 | Borlodan | E05B 77/06 |
| 2020/0332568 | A1 * | 10/2020 | Hunt | E05B 77/04 |
| 2021/0032910 | A1 * | 2/2021 | Fuchs | E05B 79/20 |

FOREIGN PATENT DOCUMENTS

| | | | | |
|---|---|---|---|---|
| DE | 102007003948 | A1 | 5/2008 | |
| DE | 202012007312 | U1 | 11/2013 | |
| DE | 202013104118 | U1 | 12/2014 | |
| DE | 102014001490 | A1 | 7/2015 | |
| DE | 102014002581 | A1 | 8/2015 | |
| DE | 102016112182 | A1 * | 1/2018 | E05B 77/06 |
| WO | WO-2015090286 | A1 * | 6/2015 | E05B 77/06 |

* cited by examiner

*Primary Examiner* — Kristina R Fulton
*Assistant Examiner* — James E Ignaczewski
(74) *Attorney, Agent, or Firm* — Renner, Otto, Boisselle & Sklar, LLP

(57) ABSTRACT

The subject matter of the invention is a lock (1) for a motor vehicle, especially a side door lock, having a locking mechanism (2) with a catch (3) and at least one pawl (4), a release lever (10, 27), which is designed to unlock the locking mechanism (2), an actuating lever (7) for actuating the release lever (10, 27) and an inertia unit with an inertia element (12), which is designed to optionally prevent an actuating of the release lever (10, 27) depending on an actuating speed of the actuating lever (7), and the release lever (10, 27) comprises a first part (10) and a second part (27) which are designed to be coupled together.

16 Claims, 2 Drawing Sheets

MOTOR VEHICLE LOCK

Figure 1:
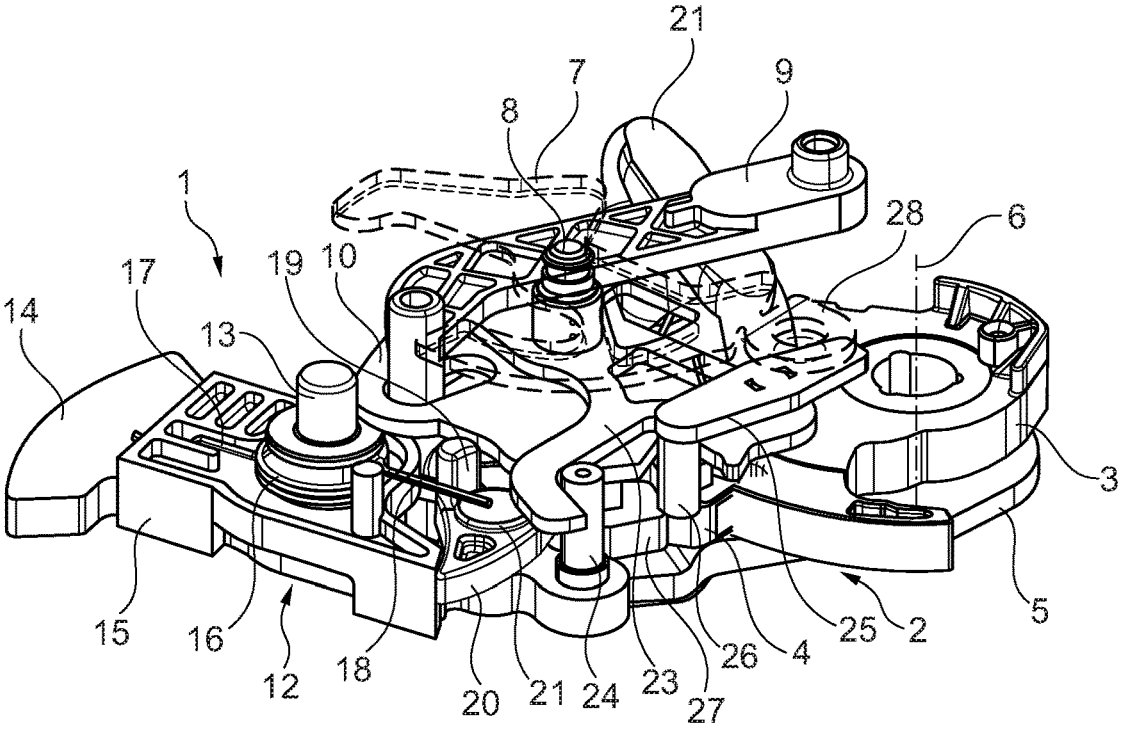

The invention relates to a lock for a motor vehicle, especially a side door lock, having a locking mechanism with a catch and at least one pawl, a release lever, which is designed to unlock the locking mechanism, an actuating lever for actuating the release lever, and an inertia unit with an inertia element, which is designed to prevent, depending on an actuating speed of the actuating lever, an actuating of the release lever.

For the most part, in a lock for a motor vehicle, also known as a lock system, locking mechanisms are installed that consist of a catch and at least one pawl. The locking mechanism interacts with a lock holder, which is secured either to the bodywork of the motor vehicle or to the door, tailgate, sliding door, etc. A relative movement between lock holder and catch has the effect of swiveling the catch, and at the same time the pawl comes into engagement with the catch.

Depending on the design, there are one or two-stage locking mechanisms, which then have a pre-ratchet and/or a main ratchet position. The pawl is preferably brought into engagement with the catch in spring-loaded manner. A release lever is used for the unlocking, that is, the releasing of the pawl from the catch. In this process, the pawl is acted upon by the release lever so that the pawl is disengaged from the catch and the catch moves from the latching position to an opening position. The movement of the catch in this case occurs mostly by means of a spring element and/or due to a tension loading, which results from the lock holder in combination with the door seal.

An actuating lever is used to actuate the release lever. The actuating lever may, for example, be an inner actuating lever, which is arranged on an inner side of a motor vehicle door, or an outer actuating lever, which is arranged on an outer side of a motor vehicle door. With the aid of the actuating lever, the release lever is moved and unlocks the locking mechanism.

To enhance the safety, motor vehicles make use of systems which are equipped with inertia elements. The inertia elements act against an external impetus and prevent a side door of a motor vehicle from being opened unintentionally, for example. An impetus may be introduced into the vehicle, for example, by a collision. If an impetus is introduced during a side impact into the motor vehicle such that, for example, a door handle of a side door is accelerated, the deflecting of the door handle may have the effect of activating the actuating lever and opening the locking mechanism, so that an unintentional opening of the side door may occur. In order to prevent such unwanted events, inertia-based lock systems have become known, which act against an unintentional opening of the locking mechanism and, consequently, of the door lock.

A motor vehicle door lock is known from DE 20 2013 104 118 U1, being provided with an inertial locking mechanism. The motor vehicle lock comprises a locking arrangement, which is outfitted with a control lever and a coupling element. The coupling element here is designed with a spring arrangement. If the actuating lever is not actuated, the locking arrangement is locked or it is only unlocked upon actuating the actuating lever under spring action. If, upon actuating the actuating lever, an actuating speed is achieved which lies above a predetermined limit speed, the inertia of the control lever ensures that the actuating of the actuating lever is delayed. The limit speed is chosen such that it is generally not exceeded when a single person performs the actuating, but it is reliably attained in event of a crash.

Furthermore, from DE 20 2012 007 312 U1 there is known a motor vehicle lock with an actuating lever and a coupling arrangement. The actuating lever interacts with the coupling arrangement such that the actuating lever in question disengages the engaged coupling arrangement and leaves the disengaged coupling arrangement in the disengaged state. In the event of an accident, if the actuating lever is actuated with an actuating speed above a given limit speed, the actuating lever performs an idle stroke on account of the inertially delayed engaging of the coupling arrangement.

From DE 10 2014 001 490 A1 there is known an inertia-based actuating system for a release lever, where the actuating lever interacts with a coupling lever which is swivel-mounted on the release lever. A spring located on the actuating lever engages with the coupling lever and thus makes it possible for the coupling lever to become engaged when the actuating lever is operated. In the engaged state, the locking mechanism can be unlatched by means of the release lever. In addition, a locking lever is provided, by means of which the coupling lever can be disengaged, and also in event of an inertia-related accident.

Another inertia-based locking system in a lock for a motor vehicle with a separate inertia element is known from DE 10 2014 002 581 A1. A coupling lever is mounted on an actuating lever and is spring-loaded in a position in which the coupling lever becomes engaged with the release lever upon operating the actuating lever. In the event of surpassing a limit speed of operation of the actuating lever, a locking lever acts on the coupling member, so that the coupling member is disengaged from the release lever. The locking lever, in turn, is spring-loaded on the release lever and can follow the movement of the actuating lever when the actuating lever is operated with a normal actuating speed. In the event of an accident and thus an increased speed of the actuating lever, the control lever cannot follow the movement of the actuating lever due to the inertia element in engagement with the control lever and it becomes engaged with the coupling lever. The control lever then has the effect of deflecting the coupling lever. A locking of the release mechanism for the lock may occur for example in that the inertia element is fixed in the deflected state, in which the control lever is engaged with the coupling lever, so that no unlatching of the locking mechanism can occur even upon further operation of the actuating lever.

The securing systems known from the prior art are based on a direct operating of the release lever, wherein a controlling spring element interacts with an actuating lever. This carries the danger that the release lever can be operated unintentionally, for example, when the inertia element cannot present adequate inertia against the release mechanism. This is where the invention comes in.

The problem which the invention proposes to solve is to provide an inertia-based actuating system for a lock of a motor vehicle with which the utmost safety can be provided in event of an exaggerated speed of the actuating lever. Furthermore, the problem of the invention is to provide a simply designed and economical possibility for securing a lock in event of an accident.

The problem is solved according to the invention by the features of the independent patent claim 1. Advantageous embodiments of the invention are indicated in the dependent claims. It is pointed out that the sample embodiments described below are not limiting, but rather any given variation possibilities of the features described in the specification, the dependent claims, and the drawings are possible.

According to patent claim 1, the problem of the invention is solved by providing a lock for a motor vehicle, especially a side door lock, having a locking mechanism with a catch and at least one pawl, a release lever, which is designed to unlock the locking mechanism, an actuating lever for actuating the release lever, and an inertia unit with an inertia element, which is designed to prevent, depending on an actuating speed of the actuating lever, an actuating of the release lever, and wherein the release lever comprises a first part and a second part which are designed to be coupled together. By the inertia element being designed to prevent, depending on an actuating speed of the actuating lever, an actuating of the release lever is meant in this regard that the inertia element enables the actuating of the release lever by the actuating lever at an actuating speed below or equal to a given limit speed and at an actuating speed above the limit speed it prevents the actuating. "Prevent" should be taken to mean in this context that an actuating of the release lever is prevented at least to the extent that an unlatching of the locking mechanism is prevented. This may be accomplished, for example, in that the inertia element upon exceeding the limit speed ensures that the actuating lever is partly or fully disengaged from the release lever so that an actuating of the actuating lever does not result in any movement of the release lever or it results in a movement of the release lever which does not result in the unlatching of the locking mechanism. In one alternative, the inertia element may also be designed to block a movement of the release lever upon exceeding the limit speed, so that the release lever is prevented from unlatching the locking mechanism.

Preferably, the inertia element is designed to prevent a coupling of the first part of the release lever with the second part upon exceeding the limit speed. Thanks to the construction of the inertia-based lock system according to the invention, the possibility is now created to control the unlatching of the locking mechanism with a two-part release lever, included after the actuating lever, and thus to prevent an unintentional opening of the locking mechanism in event of a high actuating speed of the actuating lever. In particular, thanks to the two-part construction of the release lever, an interaction can be generated between release lever and inertia element. By incorporating the release lever in the safety chain by means of the inertia element, the utmost safety can be generated so that an unlatching of the locking mechanism occurs only at a proper, that is, a customary actuating speed of the actuating lever.

The lock for a motor vehicle also encompasses locks which are used, for example, in sliding doors, rear locks, side doors, tailgates, or also covers such as a soft top cover. The lock usually comprises a locking mechanism consisting of a catch and at least one pawl. The locking mechanism may be designed with a main ratchet, and preferably also with a pre-ratchet, wherein one or two pawls are used. By a "main ratchet" is meant in this context a latching position in which the pawl or one of the pawls engages the catch and secures it in a position in which the catch encloses the lock holder and thus holds the door closed. By a "pre-ratchet" is meant in this context a latching position in which the pawl or one of the pawls engages the catch and secures it in a position in which the catch has not yet assumed it total closing position for the closing of the door.

The release lever in an engaged position interacts with the locking mechanism and unlatches the locking mechanism, while the release lever brings the pawl out of engagement with the catch. The speed of the actuating lever is a measure for the operation. If the actuating speed of the actuating lever surpasses a limit, the inertia element will prevent an engaging of the two-part release lever, preventing an unlatching of the locking mechanism.

An advantageous embodiment of the invention is obtained if the lock comprises a spring-loaded coupling lever, which connects the first part of the release lever to the second part of the release lever in swiveling manner. "Connected by means of a spring-loaded coupling lever" should be taken to mean that the first part of the release lever is not connected, i.e., coupled constantly to the second part, and it is connected via a swivel movement by means of the spring-loaded coupling lever. The release lever is preferably accommodated as a swiveling component in the motor vehicle lock, so that an easy and secure coupling of the parts of the release lever can be assured. In particular, a swiveling arrangement of the release lever can provide an adequate force for securely opening the locking mechanism even under increased loads and/or temperature influences.

On the one hand, a secure and long-lasting stable connection of the release lever is assured and on the other hand the torque on the pawl can be adjusted via the diameter of the swiveling connected parts of the release lever or the length of the lever. When speaking of a torque in this regard, this also means the force which is transmitted from the release lever to the pawl, it being assumed that release lever and pawl are accommodated in swiveling manner in the motor vehicle lock, so that a torque can be determined from the force transmitted.

One advantageous variant embodiment of the invention results when the first part and second part of the release lever are mounted on a common axle. A common mounting of the parts of the release lever affords the advantage of a small number of components in the motor vehicle lock, which in turn has a positive impact on the costs during manufacture of the motor vehicle lock. Furthermore, thanks to the common mounting the structural space for the interplay of release lever and locking mechanism is reduced, so that the motor vehicle lock has the smallest possible design overall. In advantageous manner, a coupling of the first and second part of the release lever can adjust the force transmission ratio between first and second part of the release lever, which also includes a neutral ratio of 1:1. This further simplifies the design and calculation of the motor vehicle lock and broadens its design possibilities.

It may also be advantageous when the inertia unit comprises a control lever for interacting with the first part of the release lever, which is mounted in swiveling manner on the inertia element and comprises a leg spring, which couples the inertia element to the control lever, wherein the control lever can deflect the inertia element by means of the leg spring, depending on an actuating speed. The first part of the release lever thus interacts directly with the inertia unit, making possible a control and a securing against unintentional opening which is independent of the operating mechanism. Thus, while the system for protection against an acceleration, for example in the event of an accident, is connected to the speed of the actuating lever, it only acts directly on the inertia element. The release lever itself interacts with the control lever and can control an engaging between the two parts of the release lever independently of the actuating lever. In advantageous manner, the operating of the actuating lever depends on the existence of a locking of the motor vehicle lock. If the motor vehicle lock is present in a locked state, the actuating lever will be arranged in the motor vehicle lock such that the release lever is not operated. Thus, the actuating lever then only acts on the release lever if the motor vehicle lock is unlocked. Besides the safety of the locking of the motor vehicle lock, the inertia-based control of the engaging between the two parts of the release lever affords an additional measure of safety against unintentional opening of the motor vehicle lock under extreme conditions.

It may furthermore be advantageous when the second part of the release lever can be brought into direct engagement with the pawl. The second part of the release lever is in direct engagement with the pawl and/or arranged so that the pawl can be guided by means of the second part of the release lever. Preferably, the pawl and the second part of the release lever are accommodated in the motor vehicle lock, swiveling on a common axle. Thanks to the common mounting and the positive locking, for example, between the second part of the release lever and the pawl, a secure operating of the pawl can be assured. In advantageous manner, the direct interplay between the second part of the release lever and the pawl can also ensure a secure blocking of the movement of the pawl in event of an extreme loading.

The second part of the release lever has a recess for the engaging of the coupling lever. In a starting position of the motor vehicle lock, that is, in the non-activated state of the actuating lever, the coupling lever lies against an outer contour of the second part of the release lever. Only in the event that the actuating lever swivels the first part of the coupling lever by means of a normal actuating speed does a recess in the first part of the release lever lie up with a recess in the second part of the release lever, so that the coupling lever can drop into it. If the first part of the release lever is operated at excessive speed, the control means prevents a movement of the inertia element and thus a movement of the first and second part of the release lever, which can prevent the coupling lever from dropping in.

Another advantageous variant embodiment of the invention also results if the lock comprises a guide lever for guiding the coupling lever. The coupling lever is received in the guide lever in swiveling manner and forms together with the coupling lever a coupling unit. By a movement of the guide lever in concert with the release lever and the inertia unit it is possible for the coupling lever to reach a coupling position. In this case, the coupling lever lies spring-loaded against an outer contour of the release lever. Due to the geometrical formation of the coupling lever, a secure engaging and disengaging is thereby assured. Preferably, for this purpose, radii and/or conical elevations are formed on the coupling lever, which ensure an easy and secure engaging and disengaging.

The guide lever can furthermore be actuated by means of the inertia element, especially by means of a cylindrical extension on the inertia element. This produces an advantageous design variant, since the engaging is connected to the movement of the inertia element. The guide lever is operated by means of a cylindrical extension on the inertia element, which provides an additional means of securing the position of the inertia element. At a normal actuating speed, the first part of the release lever is able to operate the inertia element by means of the force of the leg spring and hence swivel the guide lever at the same time. The swiveling of the guide lever means that the coupling lever can be positioned to match up with the recesses in the release lever and an engaging can occur. In event of excessive acceleration of the actuating lever, the interplay between guide lever and inertia element means that the inertia element additionally undergoes a securing of its position. The inertia element in this case, thanks to the frictional locking and/or positive locking forces between guide lever and cylindrical extension on the inertia element, is held in its position. Preferably, the cylindrical extension is situated at a radial end of the inertia element, resulting advantageously in a stabilizing of the inertia element.

Thus, due to the construction of the motor vehicle lock according to the invention, an inertia-based securing system is provided with which a secure, long-term and stable prevention of an unintentional opening of a motor vehicle lock is accomplished. Furthermore, thanks to the diverse options for mounting of the kinematics, a compact and economical solution can be provided for an active mass latch.

In the following, the invention shall be explained more closely with reference to the accompanying drawings showing a preferred sample embodiment. However, the principle shall hold that the sample embodiments do not limit the invention, but rather only represent advantageous embodiments. The features represented may be implemented alone or in combination with other features of the specification, as well as the patent claims alone or in combination.

Figure 2:
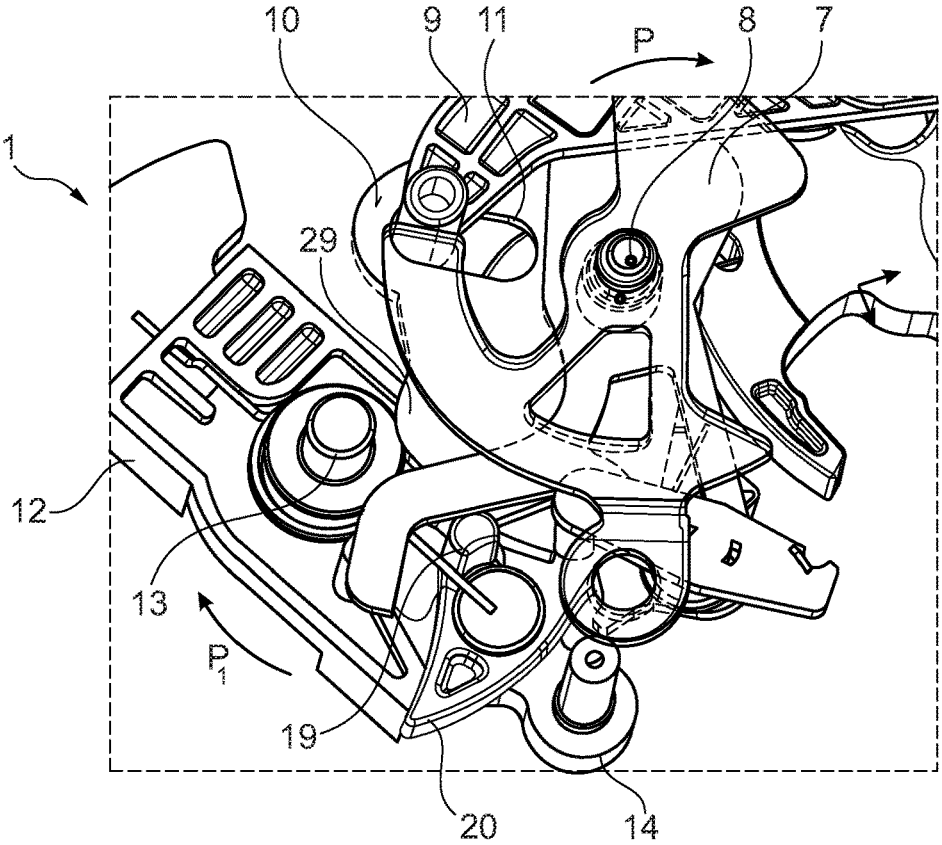
Figure 3:
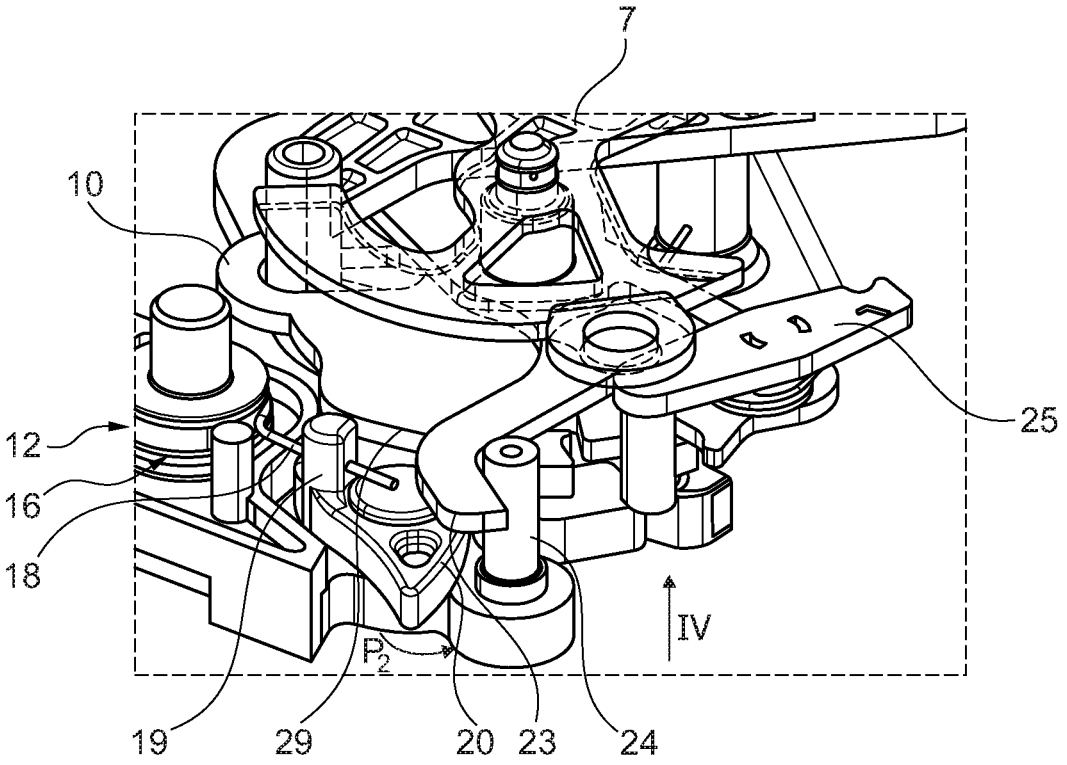
Figure 4:
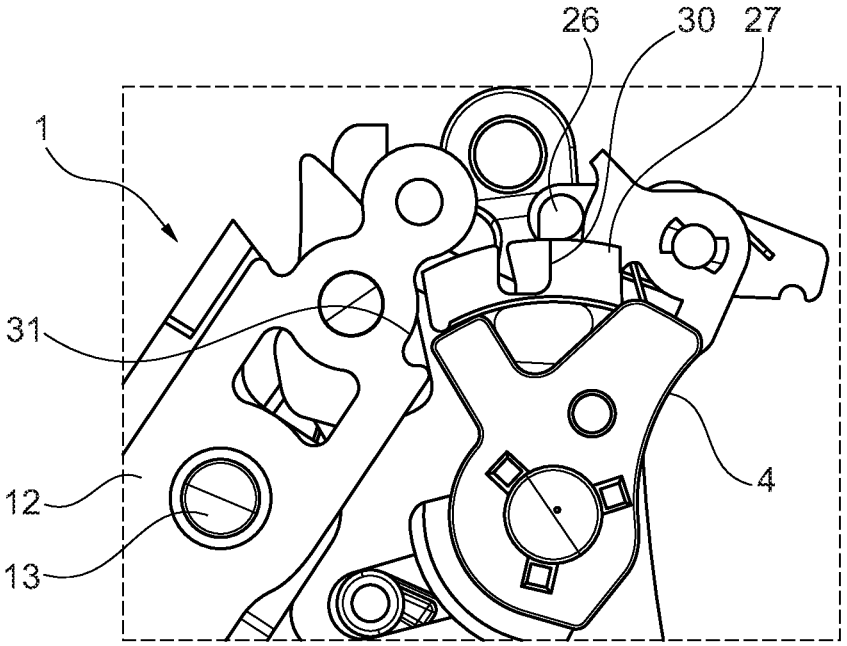

There are shown:

FIG. 1 a three-dimensional view of a motor vehicle lock configured according to the invention, where only the components needed to explain the invention are shown and where the lock system is represented in a main ratchet position, FIG. 2 the motor vehicle lock according to the invention in a release position, that is, an unlatched position of the locking mechanism, at a normal actuating speed of the actuating lever, FIG. 3 the motor vehicle lock according to the invention in a three-dimensional view upon operation of the actuating lever with elevated speed, and FIG. 4 a view from the direction of the arrow IV in FIG. 3 of the locking mechanism according to the invention after an operating of the actuating lever with elevated speed.

FIG. 1 shows a motor vehicle lock 1 without a housing and with only the essential components for the explanation of the invention. The motor vehicle lock 1 comprises a locking mechanism 2 composed of a catch 3 and a pawl 4, the locking mechanism 2 being represented in a latched position, preferably a main latched position. The locking mechanism 2 is accommodated in a lock plate 5 and is able to swivel in the motor vehicle lock 1 by means of a rotary axis 6, not shown. For the unlatching of the locking mechanism 2, an actuating lever 7 is swiveled clockwise about an axis 8. In this way, the actuating lever 7 comes into engagement with a central locking lever 9, so that a first part of a release lever 10 can likewise swivel clockwise about the axis 8. The central locking lever 9 is mounted movably in an opening 11 of the first part of the release lever 10. The opening 11 is more clearly seen in FIG. 2. By a displacement of the central locking lever 9 in the opening 11 from the position shown in FIG. 1 to the right, the actuating lever 7 can be disabled. This can be accomplished because the actuating lever 7 comprises a projection and a recess: in the position of the central locking levers 9 represented in FIG. 1, the projection of the actuating lever comes into engagement with the central locking lever 9 and the central locking lever 9 is thereby swiveled, whereas in the position of the central locking levers 9 represented in FIG. 1 it is received by the recess when the actuating lever 7 is operated, so that there is no deflecting of the central locking lever 9 by swiveling of the actuating lever 7. Hence, not only does the central locking lever 9 make possible a locking and thus a securing of the motor vehicle lock, but also it is part of an actuating lever chain for the unlatching of the locking mechanism. The further components for the operation of the central locking lever 9, which may also be electrically powered, are not shown in the figures.

Also received in swiveling manner in the motor vehicle lock 1 is an inertia element 12, the inertia element 12 being received preferably in the lock box 5 or a lock housing, not shown, to swivel about the axis 13. The inertia element 12 comprises a metal base body 14 and a plastic body 15, enclosing the metal base body 14 at least for a portion, wherein the plastic body 15 can be secured on the base body 14 for example by overmolding of the base body 14. Yet it is also conceivable for the plastic body 15 to be connected to the base body 14 by positive locking. The plastic body 15 may serve at the same time for the mounting of the inertia element 12 on the axis 13. At the same time, the plastic body 15 serves for receiving a leg spring 16, which is formed as a spiral spring with two spring legs 17, 18. A first spring leg 17 is held with positive locking in the plastic body 15, while a second spring leg 18 comes to bear against a contour 19 of a control lever 20. With the aid of the leg spring 16, a force can be exerted on the control lever 20, which biases the control lever 20 about the axis 21 against the plastic body 15. Thus, the control lever 20 is spring-loaded against the plastic carrier 15 of the inertia element 12 in the non-activated position of the motor vehicle lock 1. The control lever 20 is mounted in swiveling manner on the inertia element 12. The inertia element 12, the control lever 20 and the leg spring 16 form an inertia unit.

There is shown a starting position of the motor vehicle lock 1, in which a lock holder 21 has been fixed by means of the locking mechanism 2 in a closed position. Thus, the motor vehicle lock 1 is holding a component, movably attached to the motor vehicle, in its closed position.

Furthermore, there may be recognized in FIG. 1 a guide lever 23, the guide lever 23 likewise be accommodated in the motor vehicle lock 1, able to swivel about the axis 8, and resting spring-loaded against a cylindrical extension 24 of the inertia element 12. A coupling lever 25 is accommodated in the guide lever 23, being able to swivel and being biased in the clockwise direction. In the non-activated position, a cylinder pin 26 of the coupling lever 25 lies against an outer surface of a second part of a release lever 27. The coupling lever 25 lies spring-loaded by means of the cylinder pin 26 against the second part of the release lever 27, without coupling the first part of the release lever 10 to the second part of the release lever 27.

FIG. 1 consequently shows an unlocked lock system with a latched locking mechanism 2 in the non-activated state. For the unlatching of the locking mechanism, the seat 28 is swiveled clockwise about the axis 8, for example by means of a Bowden cable.

FIG. 2 now shows the unlatched position of the motor vehicle lock 1 at a normal actuating speed of the actuating lever 7. For the unlatching of the locking mechanism, the actuating lever 7 has been swiveled in the direction of the arrow P about the axis 8. The actuating lever 7 has likewise swiveled the first part of the release lever 10 clockwise in the direction of the arrow P via the central locking lever 9. Thanks to the swiveling of the first part of the release lever 10, a control contour 29 of the first part 10 of the release lever comes into engagement with the contour 19 of the control lever 20, whereby the inertia element 12 is swiveled in the direction of the arrow P1 about the axis 13. The swiveling of the inertia element 12 occurs via the contour 19, the control lever 20, the axis 21 and the base body 14. It is important in this interplay of the motor vehicle lock components that the control lever 20 swivels the inertia element 12 by means of the interposed leg spring 16. The swiveling of the inertia element 12 is thus dependent on the spring constant of the leg spring 16. In the normal operation of the motor vehicle lock 1 represented in FIG. 2, the inertia element is swiveled by means of the contour 29 and via the control lever 20. But this swiveling occurs only at a normal actuating speed of the actuating lever 7, since at a normal actuating speed the force of the spring is enough to swivel the inertia element 12 about the axis 13.

The swiveling of the inertia element 12 makes it possible at the same time for the cylinder pin 26 to engage in a recess 30 of the second part of the release lever 27. For the cylinder pin 26 to engage, a swiveling of the inertia element 12 is necessary, since the swiveling of the inertia element 12 releases the second part of the release lever 27 for a swivel movement. The blocking of the coupling of the cylinder pin 26 between first part of the release lever 10 and second part of the release lever 27 can only occur in event of a swiveling of the inertia element 12, as explained below.

FIG. 3 now shows the operation of the actuating lever 7 at an elevated actuating speed, lying above a predetermined limit speed, wherein once again the contour 29 likewise interacts with the control lever 20 via the contour 19. Due to the elevated actuating speed, the leg spring 16 is compressed, since the spring force of the leg spring 16 is chosen such that at an actuating speed above the predetermined limit speed the leg spring 16 will be compressed. In this way, the control lever 20 swivels counterclockwise in the direction of the arrow P2 and against the force of the leg spring 16. In other words, the spring leg 18 has been deflected by means of the contour 19. Thus, the operating of the actuating lever 7 and hence the operating of the first part of the release lever 10 has the result that the control lever 20 was swiveled, without the inertia element 12 performing a swivel movement. The inertia element 12 stays in its starting position, so that the guide lever 23 likewise remains in its spring-loaded abutment with the cylindrical extension 24. Hence, the inertia element 12 and the guide lever 23 are not swiveled, so that at the same time the coupling lever 25 remains in its starting position. There only occurs a swiveling of the first part of the release lever 10, yet no engaging of the cylinder pin 26 in the recess 30 of the second part of the release lever 27 can occur in this way.

FIG. 4 is a view of the motor vehicle lock 1 looking along arrow IV of FIG. 3. One can clearly notice that the second part of the release lever 27 cannot swivel, since the second part of the release lever 27, as well as the pawl 4, comes to bear against the outer edge of the inertia element 12. The cylinder pin 26 is not able to arrive in the recess 30, so that an opening of the locking mechanism 2 is prevented. In particular, after an operation of the actuating lever 7 with elevated speed, every movement of the pawl 4 will be blocked by the inertia element 12. In order to lift the blocking by the inertia element 12, it is necessary to fully reset the actuating lever 7. After this, unlatching can be done by means of an operating of the actuating lever 7 at normal actuating speed of the locking mechanism. Consequently, an inertia-based securement is realized for a motor vehicle lock 1, offering the utmost in safety. In particular, thanks to the two-part construction of the release lever 10, 27, an unlatching of the locking mechanism can be securely prevented in event of an excessive acceleration, as for example in an accident.

LIST OF REFERENCE SYMBOLS

1 Motor vehicle lock
2 Locking mechanism

3 Catch
4 Pawl
5 Lock plate
6, 8, 13, 21 Axle
7 Actuating lever
9 Central locking lever
10 First part of release lever
11 Opening
12 Inertia element
14 Metal base body
15 Plastic body
16 Leg spring
17, 18 Spring leg
19 Contour
20 Control lever
22 Lock holder
23 Guide lever
24 Cylindrical extension
25 Coupling lever
26 Cylinder pin
27 Second part of release lever
28 Seat
29 Control contour
30 Recess
31 Outer edge
P, P1, P2 Arrow

The invention claimed is:

1. A motor vehicle lock for a motor vehicle side door, the motor vehicle lock comprising:

a locking mechanism having a catch and at least one pawl, a two-part release lever which unlocks the locking mechanism, an actuating lever for actuating the release lever, and an inertia unit having an inertia element that prevents, depending on an actuating speed of the actuating lever, the actuating of the release lever, wherein the release lever has a first part and a second part which are coupled together, wherein the inertia unit has a control lever for interacting with the first part of the release lever, the control lever being mounted in a swiveling manner on the inertia element, and a leg spring which couples the inertia element to the control lever, wherein the control lever deflects the inertia element by the leg spring depending on the actuating speed.

2. The motor vehicle lock of claim 1, further comprising a spring-loaded coupling lever which connects the first part of the release lever to the second part of the release lever in a swiveling manner.

3. The motor vehicle lock of claim 1 further comprising a common axle on which the first part and the second part of the release lever are mounted on.

4. The motor vehicle lock of claim 1, wherein the second part of the release lever can be brought into direct engagement with the pawl.

5. The motor vehicle lock of claim 2, wherein the second part of the release lever has a recess for engaging the coupling lever.

6. The motor vehicle lock of claim 2, further comprising a guide lever for guiding the coupling lever.

7. The motor vehicle lock of claim 6, wherein the guide lever is mounted on a same axle as the release lever.

8. The motor vehicle lock of claim 6, wherein the guide lever can be actuated by the inertia element.

9. The motor vehicle lock of claim 7, wherein the guide lever can be actuated by a cylindrical extension of the inertia element.

10. The motor vehicle lock of claim 2, further comprising a common axle on which the first part and the second part of the release lever are mounted on.

11. The motor vehicle lock of claim 2, wherein the second part of the release lever can be brought into direct engagement with the pawl.

12. The motor vehicle lock of claim 8, wherein the inertia element includes a cylindrical extension for actuating the guide lever.

13. The motor vehicle lock of claim 1, wherein the inertia element has a metal base body and a plastic body that encloses at least a portion of the metal base body.

14. The motor vehicle lock of claim 1, wherein the control lever is spring-loaded against the plastic body of the inertia element when the motor vehicle lock is in a non-activated position.

15. The motor vehicle lock of claim 1, wherein the first part of the release lever has a control contour and the control lever has a contour that is engageable with the control contour of the first part of the release lever.

16. A motor vehicle lock for a motor vehicle side door, the motor vehicle lock comprising:

a locking mechanism having a catch and at least one pawl, a release lever which unlocks the locking mechanism, an actuating lever for actuating the release lever, an inertia unit having an inertia element that prevents, depending on an actuating speed of the actuating lever, the actuating of the release lever, wherein the release lever has a first part and a second part which are coupled together, a spring-loaded coupling lever which connects the first part of the release lever to the second part of the release lever in a swiveling manner, and a guide lever for guiding the coupling lever, and a leg spring which couples the inertia element to the control lever, wherein the control lever can deflect the inertia element by the leg spring depending on the actuating speed.

* * * * *